US005994849A

United States Patent [19]

Vollkommer et al.

[11] Patent Number: 5,994,849

[45] **Date of Patent: *Nov. 30, 1999**

[54] METHOD FOR OPERATING A LIGHTING SYSTEM AND SUITABLE LIGHTING SYSTEM THEREFOR

[75] Inventors: Frank Vollkommer, Buchendorf; Lothar Hitzscke; Klaus Stockwald, both of Munich, all of Germany

[73] Assignee: Patent-Treuhand-Gesellschaft fuer electrische Gluehlampen mbH, Munich, Germany

[ * ] Notice: This patent is subject to a terminal disclaimer.

[21] Appl. No.: 08/983,113

[22] PCT Filed: Jul. 18, 1996

[86] PCT No.: PCT/DE96/01317

§ 371 Date: Jan. 7, 1998

§ 102(e) Date: Jan. 7, 1998

[87] PCT Pub. No.: WO97/04625

PCT Pub. Date: Feb. 6, 1997

[30] Foreign Application Priority Data

Jul. 18, 1995 [DE] Germany ..... 195 26 211

[51] Int. Cl.[6] ..... H05B 41/00

[52] U.S. Cl. ..... 315/246; 315/250; 315/260; 313/607

[58] Field of Search ..... 315/250, 39, 248, 315/344, 246, 260; 313/607, 594

[56] References Cited

U.S. PATENT DOCUMENTS

| | | | |
|---|---|---|---|
| 3,648,100 | 3/1972 | Goldie et al. | 315/39 |
| 3,649,864 | 3/1972 | Willemsen | 313/221 |
| 4,427,922 | 1/1984 | Proud et al. | 315/39 |
| 4,427,923 | 1/1984 | Proud et al. | 315/39 |
| 4,427,924 | 1/1984 | Proud et al. | 315/39 |
| 4,430,577 | 2/1984 | Bouquet | 315/39 |
| 5,561,351 | 10/1996 | Vrionis et al. | 315/248 |
| 5,581,152 | 12/1996 | Matsuno et al. | 313/634 |
| 5,604,410 | 2/1997 | Vollkommer et al. | 315/246 |

FOREIGN PATENT DOCUMENTS

| | | |
|---|---|---|
| 0302748 | 2/1989 | European Pat. Off. . |
| 0363832 | 4/1990 | European Pat. Off. . |
| 0521553 | 1/1993 | European Pat. Off. . |
| 0604902 | 7/1994 | European Pat. Off. . |
| 2600592 | 7/1977 | Germany . |
| 4036122 | 6/1991 | Germany . |
| 60-172135 | 9/1985 | Japan . |
| 94/23442 | 10/1994 | WIPO . |

*Primary Examiner*—Don Wong
*Assistant Examiner*—Wilson Lee
*Attorney, Agent, or Firm*—Carlo S. Bessone

[57] ABSTRACT

The invention pertains to a method for operating a lighting system with an incoherently-emitting radiation source, in particular a discharge lamp (14) that emits UV, IR or visible-range radiation, by means of dielectrically inhibited discharge, and to a lighting system suitable therefor. The electrodes (16–20), which are arranged side by side and separated from each other and the interior of the discharge vessel (15) by dielectric material (21), are alternatingly connected to the two poles (23, 24) of a voltage source (27). In operation, the voltage source (27) supplies a series of voltage pulses separated by quiescent periods. According to the invention, this produces inside the discharge vessel (15) a spatial discharge (26) which in the regions between electrodes of different polarity (16, 17; 17, 18; 18, 19; 19, 20) is at a distance from the surface of the inside wall of the discharge vessel (15). Substantial advantages are less stress on the wall of the discharge vessel and greater efficiency in generating radiation.

18 Claims, 6 Drawing Sheets

METHOD FOR OPERATING A LIGHTING SYSTEM AND SUITABLE LIGHTING SYSTEM THEREFOR

TECHNICAL FIELD

Figure 1A:
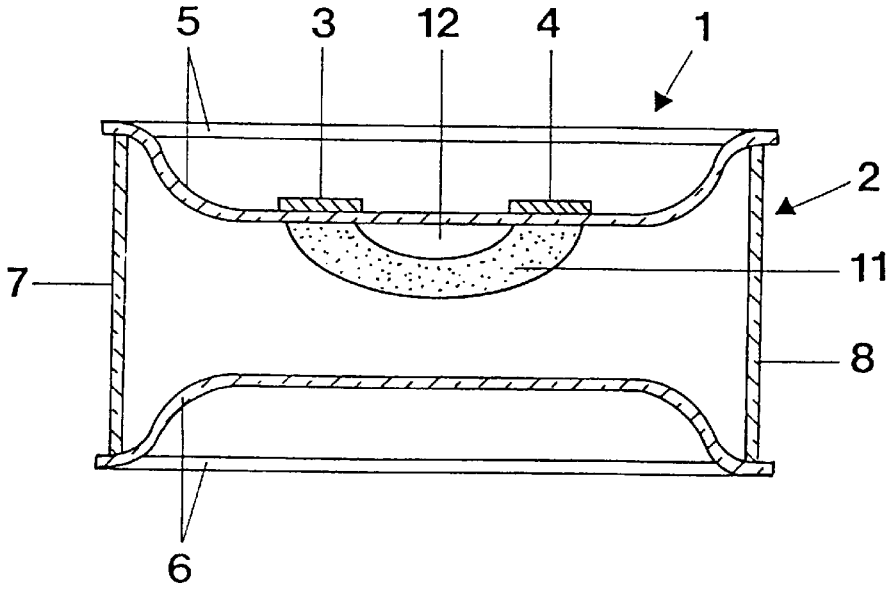

The invention concerns a method for operating a lighting system with an incoherently emitting radiation source, particularly a discharge lamp, by means of dielectrically impeded discharge in accordance with the preamble of claim 1. The invention also concerns a lighting system suited for the said method of operation in accordance with the preamble of claim 12.

Incoherently emitting radiation sources are understood to be UV (Ultraviolet) and IR (Infrared) radiators as well as discharge lamps, in particular, those which radiate visible light.

INDUSTRIAL USES

These types of radiation sources are suited, according to the spectrum of the emitted radiation, for general purpose and auxiliary lighting, for example, house and office lighting; for background lighting for displays, for example, LCD's (Liquid Crystal Displays); for automotive and signal lighting; for UV irradiation, for example, degermination or photolytics; and for IR irradiation, for example, in the drying of varnishes.

PRIOR ART

A method for operating an incoherently emitting radiation source, particularly a discharge lamp, by means of dielectrically impeded discharge was revealed in WO 94/23442. This operating method requires a sequence of voltage pulses, whereby the individual voltage pulses are separated from one another by idle times. The advantage of this pulsed operation method is a high efficiency in the generation of radiation.

EP 0 363 832 describes a UV high-power radiator with electrodes connected pairwise to the two poles of a high-voltage source. The electrodes are separated from one another and from the discharge chamber of the radiator by dielectric material. Such electrodes are hereinafter referred to as "dielectric electrodes". Also, the electrodes are arranged adjacent to one another in a way that allows flattish discharge configurations with relatively flat discharge chambers. An alternating voltage in the magnitude of several 100 V to 20,000 V with a frequency within the range of industrial alternating current of up to a few kHz is applied to the dielectric electrodes so that an electrical creeping discharge forms essentially only in the region of the dielectric surface.

The primary disadvantage in this is that the creeping discharges stress the surface thermally and, therefore, cooling channels for the dissipation of heat from the dielectric are proposed. The efficiency of the generation of radiation, particularly in the UV and VUV (Vacuum Ultraviolet) range, is limited by the unavoidable, substantial heat generation of this discharge type. Additionally, a creeping discharge causes chemical processes on the surface and shortens the life of the radiator.

PRESENTATION OF THE INVENTION

The object of the invention is to avoid these disadvantages and to specify a method for the operation of a lighting system, which is distinguished both by a flat discharge chamber and an efficient generation of radiation.

This object is achieved according to the invention by the characterizing features of claim 1. Further advantageous features are explained in the subclaims.

A further object of the invention is to specify a lighting system which is suited for the aforementioned method of operation. This object is achieved according to the invention by the characterizing features of claim 12.

The basic idea of the invention is to generate with adjacent dielectric electrodes a spatial discharge in the interior of the discharge chamber, which has a spacing from the surface of the interior wall of the discharge chamber in the regions between electrodes of opposite polarity. While in the prior art a multitude of creeping discharges along the surface of the dielectric serve to generate UV radiation, the invention suggests the use of a discharge which detaches itself from the dielectric surface and is spatially extended inside the discharge chamber.

The advantages achieved by this are a higher efficiency in the generation of UV and/or VUV Lvacuum Ultraviolet) radiation and, therefore, a reduced generation of heat. In contrast to the prior art, no cooling liquid is required for the dissipation of heat. Additionally, the discharge type according to the invention causes thermal and chemical stresses to the wall that are substantially lower than those in surface creeping discharges. Consequently, the life of the discharge chamber is extended. Moreover, in comparison to the prior art, a more homogenous, flattish, spatially diffuse luminance distribution can be realized according to the invention between the electrodes. The latter, in contrast to the channel-shaped creeping discharges, offers substantial advantages in optical image-forming lighting and/or irradiation uses, for example, photolithographic applications where diffuse luminance distributions substantially increase the efficiency of the process. In this respect, luminous patterns such as those produced by the conventional, channel-shaped luminous structures are not desired.

The method according to the invention provides that the adjacent dielectric electrodes are connected to a voltage source which provides a sequence of voltage pulses. The individual voltage pulses are separated from each other by pauses. Surprisingly, it was found that by this procedure, not only is a radiation of high efficiency generated, but that unexpectedly, a spatial discharge is generated in the interior of the discharge chamber which shows a spacing from the surface of the inner wall of the discharge chamber in the regions between electrodes of different polarity.

Starting from a repeating voltage pulse, pulse width and pause duration are chosen so that there results the spatial discharge which partially detaches itself from the dielectric surface according to the invention. Typical pulse widths and pause durations are in the range between 0.1 $\mu$s and 5 $\mu$s and 5 $\mu$s and 100 $\mu$s respectively, corresponding to a pulse repetition frequency in the range between 200 kHz and 10 kHz.

The optimal values for the pulse width and the pause duration depend in the individual case on the actual discharge configuration, that is to say, on the type and pressure of the gas filling as well as the electrode configuration. The electrode configuration is determined by the type and thickness of the dielectric, the area and shape of the electrodes, as well as the electrode spacing. Corresponding to the discharge configuration, the voltage signal to be applied should be chosen so that it generates a discharge which detaches itself from the dielectric surface and that has the maximum radiant efficacy at a desired electric power density. In principle the sequences of voltage pulses disclosed in WO 94/23442 are also suited for this. The height of the voltage pulses is typically between about 100 V and 10 kV. The shape of the current pulses is determined by the shape of the voltage pulse and by the discharge configuration.

Two or more longish electrodes of electrically conductive material, for example metallic wires or strips or also narrow metal coatings applied to, for example, vapor-deposited on, the exterior of the chamber wall are suited for the electrode configuration. It is preferred that the electrodes are arranged parallel to and equidistant from one another. This is important in order to ensure the same conditions for all discharges between the respectively neighboring electrodes. A wide-area, homogenous illumination is thereby assured. Additionally, in this manner an optimal radiant efficiency is achieved by a suitable sequence of pulses. The lateral dimensions—that is to say, the diameters of the wires or the widths of the strips—can be different from anode to cathode.

The operating method according to the invention is suited for a variety of possible discharge chamber geometries, in particular for all of those that are specified in EP 0 363 832 A1. It is also of no consequence whether the discharge chamber contains a gas filling and is sealed in gas-tight manner as, for example, in discharge lamps, or whether the discharge chamber is open on both sides and has a gas or a gas mixture flowing through it, as for example, in photolytic reactors. It is only required for the method of operation that the dielectric electrodes are arranged next to one another. Next to one another in this case means that neighboring electrodes of different polarity are both located on one side of the discharge zone.

The electrodes can be arranged in a common plane, for example on the exterior surface of a wall of the discharge chamber—possibly additionally covered by a dielectric protective layer—or alternatively, directly imbedded in the chamber wall. Additionally, it is possible to arrange the electrodes in different and preferably mutually parallel planes on one side of the discharge zone. For example, depending on polarity, the successive electrodes of alternating polarity are arranged in one of two mutually offset planes, as published, for example, in DE4036122A1.

In plane discharge chambers the base or top surface advantageously serves as the wall on which the electrodes are arranged. Plane discharge arrangements are particularly suited for large area, plane illumination, for example, as back lighting for indicator panels or LCD screens, as well as for irradiation uses such as in photolithography or the curing of varnishes.

Besides plane arrangements, curved discharge chambers, for example, tubular ones, are also suited. Tubular arrangements with both sides open and through which gas or a gas mixture flows are particularly suited as photolytic reactors. In its simplest design a tubular arrangement is formed by a dielectric tube, for example with a circular cross-section. The electrodes in this case are arranged at least on or in a part of the exterior or of the wall of the tube. The discharge forms in the interior of the tube during operation. In a variant, the interior wall of the tube is coated in the region of the elecctrodes with a dielectric layer which serves as an optical reflector.

A further development on the tubular arrangement consists of two concentric tubes of different diameters and electrodes arranged on or in the interior wall of the tube with the smaller diameter. The discharge forms in the space between the two tubes during operation.

The interior wall of the discharge chamber can be coated with a phosphor coating which converts the UV and VUV radiation of the discharge into light. A variant with a phosphor coating that emits a white light is particularly suited for general lighting purposes.

The selection of the ionizable filling and, when applicable, the phosphor coating is determined by the aim of application. Inert gases, for example, neon, argon, krypton and xenon, as well as mixtures of inert gases are particularly suited. However, other filling substances can be used, for example, all of those which are commonly used in the generation of light, particularly mercury (Hg) mixtures and inert gas/mercury mixtures as well as rare earths and their halides.

The lighting system is completed by a voltage source, the output poles of which are connected to the electrodes of the discharge chamber and which delivers the aforementioned sequence of voltage pulses during operation.

DESCRIPTION OF THE ILLUSTRATIONS

The invention is explained in more detail below by a few embodiments in which

Figure 1B:
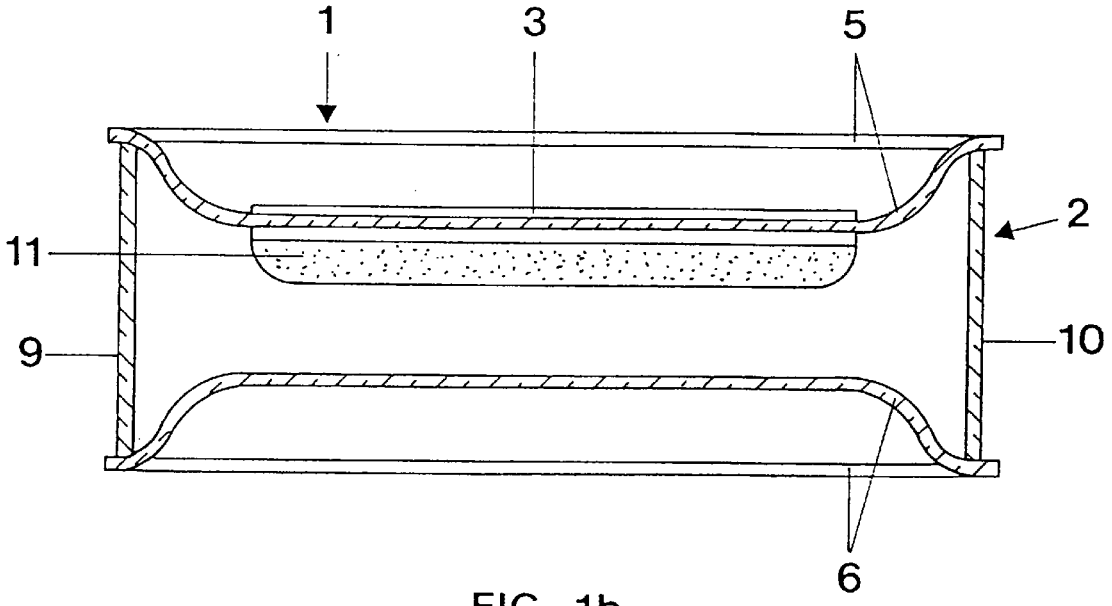
Figure 2:
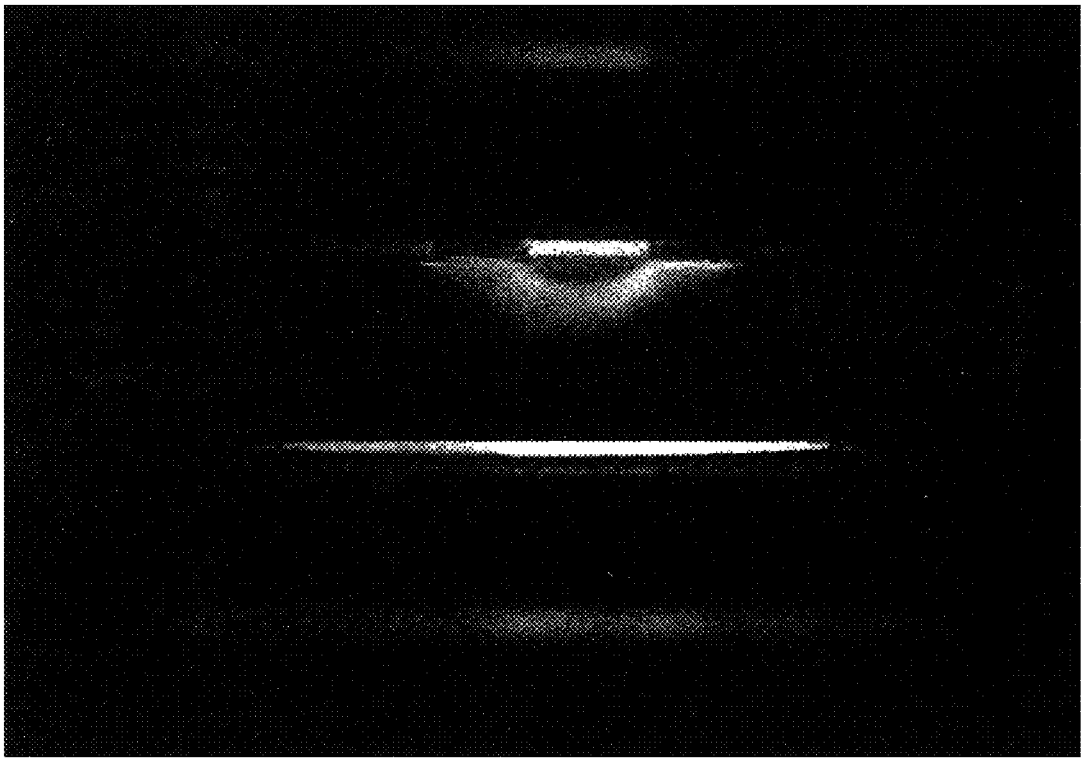
Figure 3:
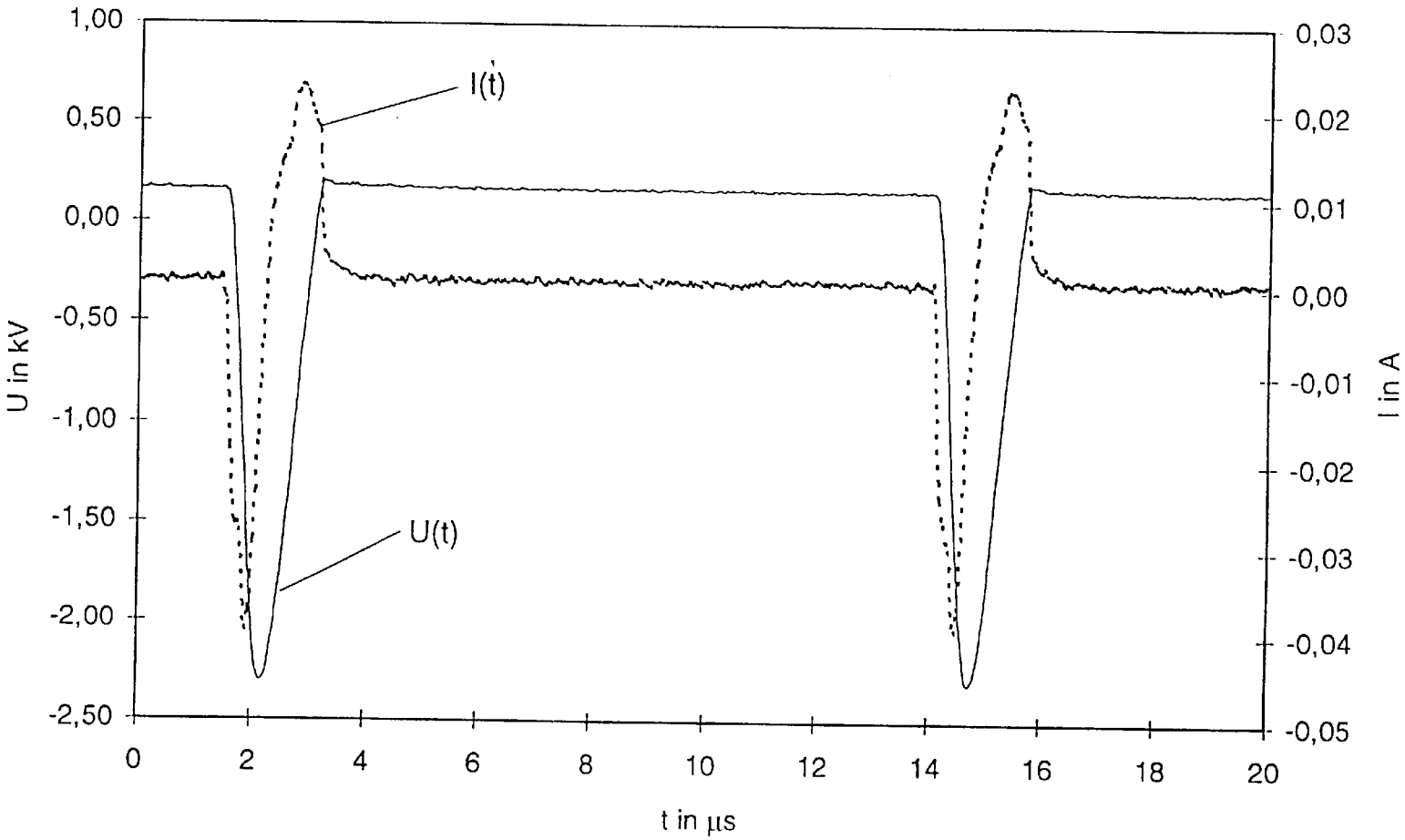
Figure 4:
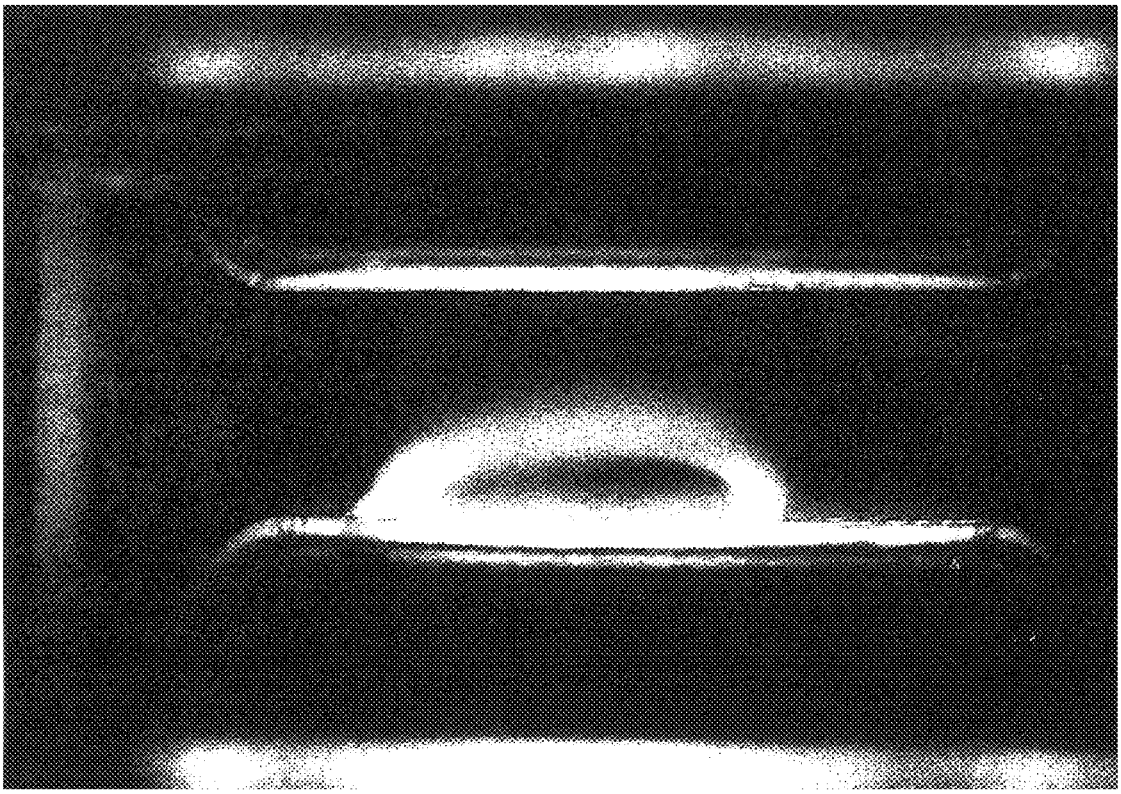
Figure 5:
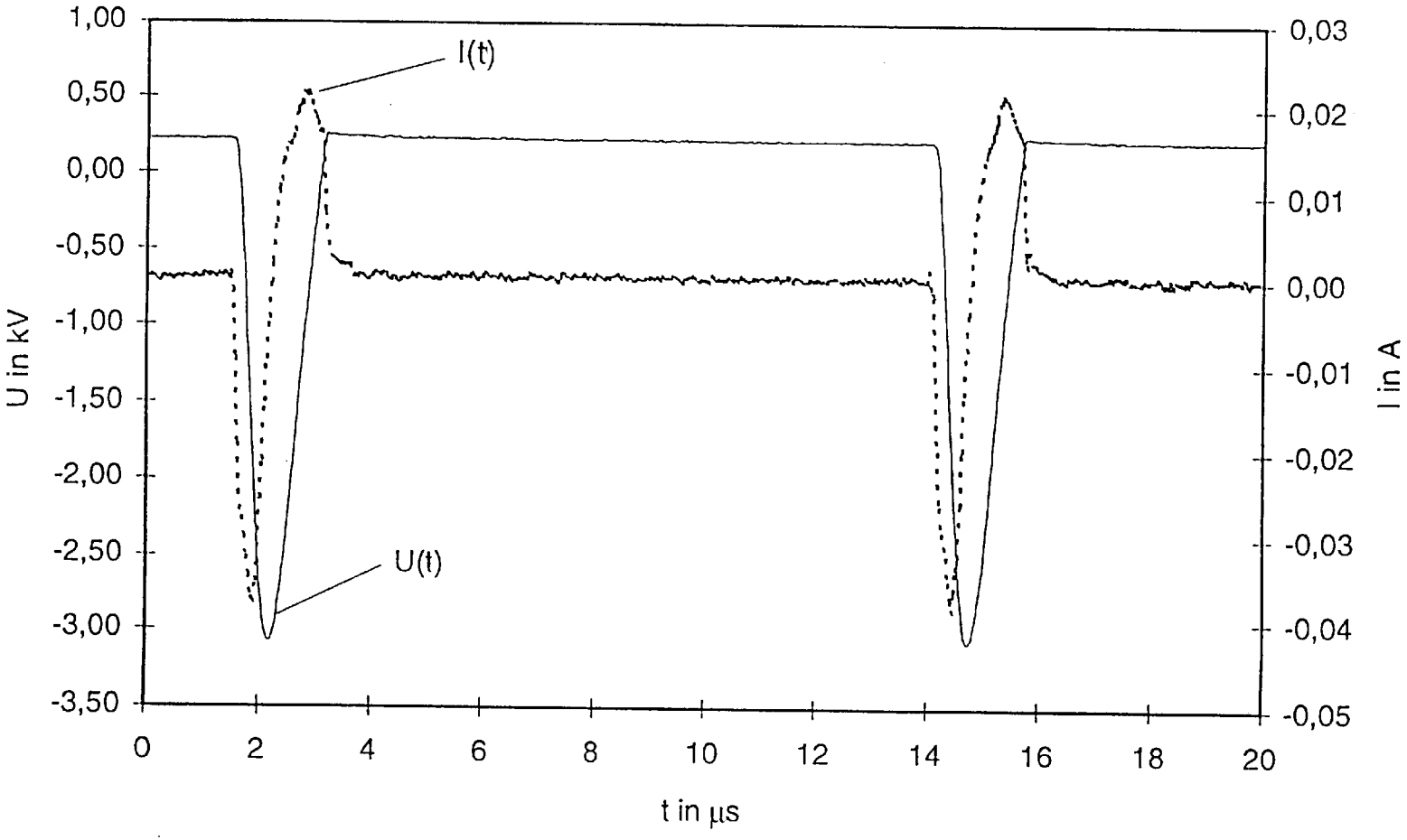
Figure 6A:
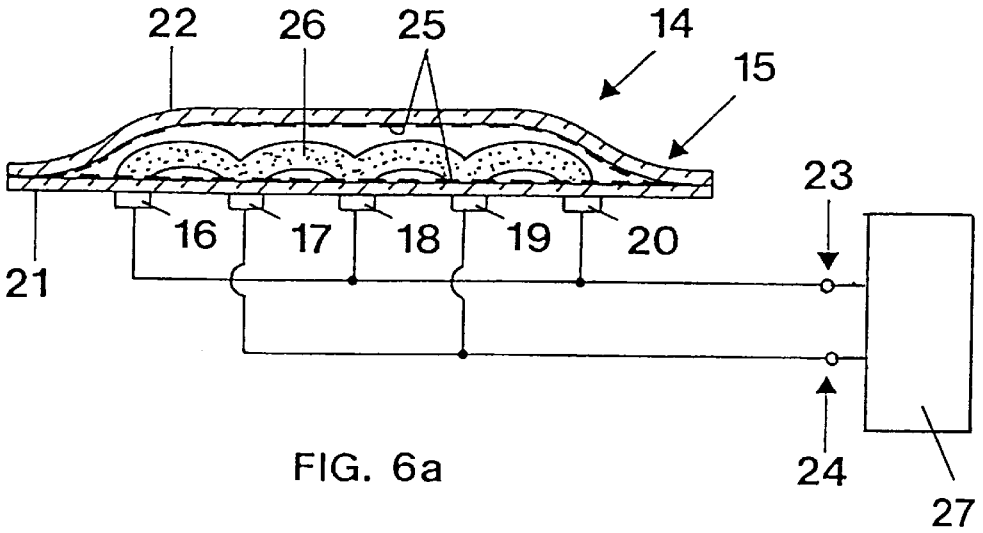
Figure 6B:
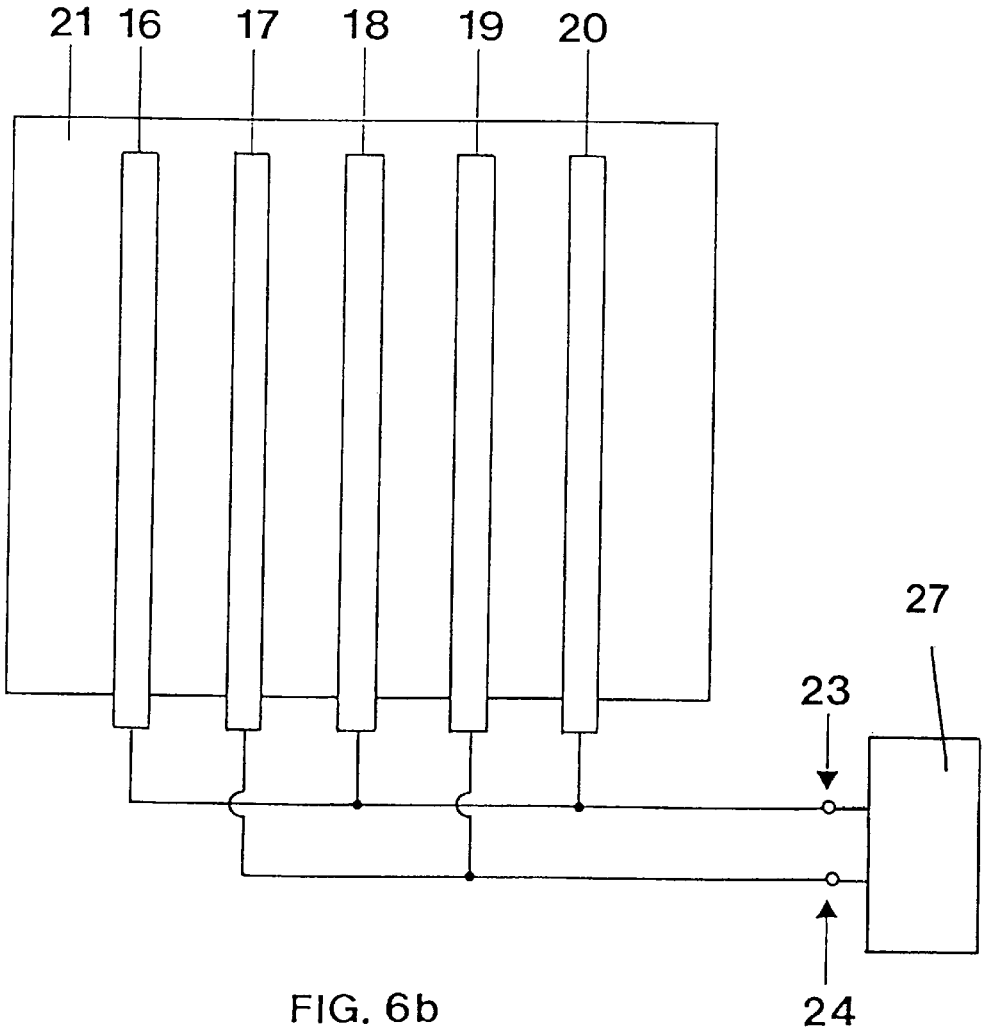

FIG. 1*a* shows the cross-section of a discharge arrangement having two dielectric electrodes arranged next to one another, FIG. 1*b* shows the longitudinal section of the discharge arrangement in FIG. 1*a*, FIG. 2 shows the end view of the discharge arrangement from FIG. 1*a* in operation according to the invention, FIG. 3 shows a detail from the temporal characteristic of current I(t) and voltage U(t) as measured at the electrodes during operation in accordance with FIG. 2, FIG. 4 is as FIG. 2, but with altered electrode geometry, FIG. 5 shows a detail from the temporal characteristic of current I(t) and voltage U(t) as measured at the electrodes during operation in accordance with FIG. 4, FIG. 6*a* shows the cross-section of a lighting system suited for the operation according to the invention, FIG. 6*b* shows the top plan view of the lighting system in FIG. 6*a*.

FIGS. 1*a* and 1*b* show a schematic representation of the cross and longitudinal sections of a discharge arrangement 1. In order to be able to better explain the core of the invention, and to further clarity, the representation is deliberately reduced to what is essential. The discharge arrangement 1 consists of a cuboid, transparent discharge chamber 2 and two parallel, strip-shaped electrodes 3, 4 which are arranged on the exterior wall of the discharge chamber 2. It may be pointed out once again at this point that similar discharge arrangements with more than two dielectric electrodes of opposite polarity arranged next to one another are, of course, equally suited for the operating method according to the invention. The discharge chamber 2 is made of glass. It consists of a cover 5 and a base 6 which are both trough-shaped and are positioned in mirrored fashion across from one another; two side walls 7, 8 which define the longitudinal axis of the discharge chamber 2 and two end walls 9, 10. The interior of the discharge chamber 2 is filled with xenon at a filling pressure of approximately 8 kPa. The two electrodes 3, 4 are made from aluminum foil. They are adhered to the exterior of the cover 5 centrally and in parallel. The cover 5 is made of glass of 1 mm thickness and functions additionally as a dielectric layer between the two electrodes and the discharge 11—which is depicted here only in a rough schematic illustration—which forms in the interior of the discharge chamber 2 during operation. According to the invention, the discharge 11 is separated from the interior wall of the cover 5 in the region between the two electrodes 3, 4 by a dark zone 12 (in longitudinal section, FIG. 1*b*, not discernible). That is, the discharge 11 has a spacing from the surface of the interior wall in the aforementioned region.

FIGS. 2 and 4 show photographs of the discharge arrangements from FIGS. 1*a* and 1*b*. The corresponding reference numbers used above are again used to explain the photographs. The two photos were both taken with a view towards the end wall 9 in the direction of the longitudinal axis. They differ from one another only in the electrode geometry. The width of the strip-shaped electrodes 3, 4 as well as their distance from each other is 3 mm and 4 mm respectively in the first case and 1 mm and 10 mm respectively in the second case. In the first case (FIG. 2, above) the electrodes 3, 4 are particularly easily identified. They stand out as dark regions from the wall of the cover 5, which exactly like the opposite wall of the base 6 appears bright due to the reflected and scattered fluorescent light of the glass. The length of the electrodes is 35 mm in each case. In both cases, but particularly evident in the second case (FIG. 4) it can be seen that the auto-luminescence of the discharge is separated from the interior wall of the cover 5 by a dark zone 12 between the electrodes 3, 4. That is to say, that the discharge 11 has a spacing from the surface of the interior wall in the aforementioned region. Viewed in the direction of the longitudinal axis of the discharge arrangement 1, the discharge 11 has a trough- or channel-shaped appearance (in FIGS. 2 and 4 indiscernible due to the direction of sight, compare FIGS. 1*a* and 1*b*).

If less power is coupled into the discharge arrangement,—for example, by reducing the voltage amplitude—the continuous, channel-shaped discharge structure splits into individual structures that, as seen in FIG. 1*a*, also stand out from the dielectric surface. The individual structures have a delta-shaped form (Δ) which widens in the direction of the (momentary) anode. In the case of alternating polarity of the voltage pulses of a dual-sided dielectrically impeded discharge there appears visually an overlap of two delta-shaped structures.

FIGS. 3 and 5 show respectively details from the temporal characteristics of voltage U(t) and current I(t) measured at the electrodes during the operation in accordance with FIGS. 2 and 4, respectively. A comparison of both Figures substantiates the influence of the electrode geometry on current and voltage outlined in the introduction. In the following table the most important electrical parameters are compiled:

| | $U_p$ | $T_u$ | $f_u$ | w | P |
|---|---|---|---|---|---|
| FIG. 3 | −2.5 kV | 1 μs | 80 kHz | 9.26 μJ | 0.74 W |
| FIG. 5 | −3.4 kV | 1 μs | 80 kHz | 8.87 μJ | 0.71 W |

Table: Measured values of electrical parameters of the two discharges represented in FIGS. 2 and 4.

In the Table, $U_p$, $T_u$, $f_u$, w and P denote the height of the voltage pulses (in reference to the voltage during the pause duration), the width of the voltage pulses (full width at half height), the pulse repetition frequency, the electrical energy per pulse and the time average of the electrical power coupled in.

FIGS. 6*a* and 6*b* show the schematic representation of the cross-section and the top view (looking towards the base) of a lighting system 14 designed for operation according to the invention. The lighting system 14 consists of a flat discharge chamber 15 with a rectangular base and five strip-shaped electrodes 16–20 as well as a voltage source 27, which generates a sequence of voltage pulses during operation. The discharge chamber 15 itself consists of a rectangular base plate 21 and a trough-like cover 22. The base plate 21 and the cover 22 are connected to one another in a gas-tight manner in the region of their circumferencial edges and so enclose the gas filling of the discharge lamp 14. The gas filling is xenon at a pressure of 10 kPa. The electrodes 16–20 have equal width and are applied to the exterior wall of the base plate parallel to and equidistant from one another. This is important in order to ensure the same conditions for all discharges between the respectively neighboring electrodes. As a result, when a suitable sequence of pulses is applied, an optimum radiant efficiency and homogeneity of the luminance is achieved. For this the electrodes 16–20 are alternately connected to the two poles 23, 24 of a voltage source. That is to say, the electrode 16 and the two subsequent even numbered electrodes 18 and 20 are connected to the first pole 23 of the voltage source. In contrast the two odd numbered electrodes 17 and 19 respectively are connected to the other pole of the voltage source. Sprayed onto the interior wall of the cover 22 and the base 21 is a phosphor coating is which converts the VUV (Vacuum Ultraviolet) and UV (Ultraviolet) radiation of the discharge 26—which is depicted here only in a rough schematic illustration—into (visible) light.

What is claimed is:

1. Method for operating by means of dielectrically impeded discharge an incoherent emitting radiation source (1; 14), specifically a discharge lamp (14) having an at least partially transparent discharge chamber of electrically non-conductive material which is sealed (2; 15) and filled with a gas filling or is open and through which a gas or gas mixture flows, and having electrodes (3, 4; 16–20) which are separated from one another and from the interior of the discharge chamber (2; 15) by dielectric material (5; 21), characterized in that the electrodes are located next to one another in a common plane and on a common surface of said dielectric material and are connected in alternating fashion to the poles (23, 24) of a voltage source that delivers a sequence of voltage pulses which are separated by pauses, so that a spatial discharge (11; 26) is generated in the interior of the discharge chamber (2; 15) which has a spacing from the surface of the interior wall of the discharge chamber in the regions between electrodes of different polarity (3, 4; 16, 17; 17, 18; 18, 19; 19, 20).

2. Method according to claim 1, characterized in that the pulse width lies in a range between 0.1 μs and 10 μs.

3. Method according to claim 2, characterized in that the pulse width is in the range between 0.5 μs and 5 μs.

4. Method according to claim 1, characterized in that the pulse repetition frequency lies in the range between 1 kHz and 1 MHz.

5. Method according to claim 4, characterized in that the pulse repetition frequency lies in the range between 10 kHz and 100 kHz.

6. Method according to claim 1, characterized in that the voltage pulses have a semi-sinusoidal shape.

7. Method according to claim 1, characterized in that the pulse height lies in the range between about 100 V and 10 kV.

8. Method according to claim 1, characterized in that the wall (5; 21) of the discharge chamber (2; 15) serves as dielectric between the electrodes (3, 4; 16–20) and the discharge (11; 26).

9. Method according to claim 8, characterized in that the electrodes consist of electrically conductive strips (3, 4; 16–20) which are arranged next to one another on the exterior of the wall (5; 21).

10. Method according to claim 9, characterized in that the number of the strips (16–20) is larger than two and the strips are arranged equidistantly on the exterior of the wall (21).

11. Method according to claim 1, characterized in that the interior surface of the wall (21) of the discharge chamber (15) is provided at least partially with a phosphor coating (25).

12. Lighting system with a radiation source, specifically a discharge lamp (14) with a voltage source (27) which supplies voltage to the radiation source, whereby the radiation emitted from the radiation source is incoherent, said radiation source (14) being suited for a dielectrically impeded discharge, having an at least partially transparent discharge chamber of an electrically non-conductive material which is either sealed (15) and filled with a gas filling or is open and through which a gas or gas mixture flows, and having electrodes (16–20) which are separated from one another and from the interior of the discharge chamber (15) by dielectric material (21) and are connected to the voltage source (27), characterized in that the electrodes are located next to one another in a common plane and on a common surface of said dielectric material and are connected in alternating fashion to the poles (23, 24) of the voltage source (27) which is capable of delivering a sequence of voltage pulses which are separated by pauses, so that a spatial discharge (26) is generated in the interior of the discharge chamber (15) which has a spacing from the surface of the interior wall of the discharge chamber in the regions between electrodes of different polarity (16, 17; 17, 18; 18, 19; 19, 20).

13. Method according to claim 2, characterized in that the wall (5; 21) of the discharge chamber (2; 15) serves as dielectric between the electrodes (3, 4; 16–20) and the discharge (11; 26).

14. Method according to claim 3, characterized in that the wall (5; 21) of the discharge chamber (2; 15) serves as dielectric between the electrodes (3, 4; 16–20) and the discharge (11; 26).

15. Method according to claim 4, characterized in that the wall (5; 21) of the discharge chamber (2; 15) serves as dielectric between the electrodes (3, 4; 16–20) and the discharge (11; 26).

16. Method according to claim 5, characterized in that the wall (5; 21) of the discharge chamber (2; 15) serves as dielectric between the electrodes (3, 4; 16–20) and the discharge (11; 26).

17. Method according to claim 6, characterized in that the wall (5; 21) of the discharge chamber (2; 15) serves as dielectric between the electrodes (3, 4; 16–20) and the discharge (11; 26).

18. Method according to claim 7, characterized in that the wall (5; 21) of the discharge chamber (2; 15) serves as dielectric between the electrodes (3, 4; 16–20) and the discharge (11; 26).

* * * * *